US009425551B2

(12) United States Patent
Chen

(10) Patent No.: US 9,425,551 B2
(45) Date of Patent: Aug. 23, 2016

(54) ELECTRICAL CONNECTOR WITH TWO GUIDING POSTS

(71) Applicant: OUPIIN ELECTRONIC (KUNSHAN) CO., LTD, Kunshan (CN)

(72) Inventor: Hsin Chih Chen, Kunshan (CN)

(73) Assignee: Oupin Electronic (Kunshan) Co., Ltd. (CN)

( * ) Notice: Subject to any disclaimer, the term of this patent is extended or adjusted under 35 U.S.C. 154(b) by 0 days.

(21) Appl. No.: 14/854,501

(22) Filed: Sep. 15, 2015

(65) Prior Publication Data

US 2016/0079704 A1 Mar. 17, 2016

(30) Foreign Application Priority Data

Sep. 16, 2014 (CN) ..... 2014 2 0529468 U

(51) Int. Cl.

| | |
|---|---|
| ***H01R 13/52*** | (2006.01) |
| ***H01R 13/631*** | (2006.01) |
| *H01R 107/00* | (2006.01) |
| *H01R 12/70* | (2011.01) |
| *H01R 12/71* | (2011.01) |

(52) U.S. Cl.

CPC ..... *H01R 13/631* (2013.01); *H01R 12/7064* (2013.01); *H01R 12/716* (2013.01); *H01R 2107/00* (2013.01)

(58) Field of Classification Search

CPC ..... H01R 33/965
USPC ..... 439/248, 680, 681, 953, 357
See application file for complete search history.

(56) References Cited

U.S. PATENT DOCUMENTS

| | | | | | |
|---|---|---|---|---|---|
| 5,044,975 | A * | 9/1991 | DiBene, II | H01R 13/6275 | 439/153 |
| 5,391,091 | A * | 2/1995 | Nations | H01R 12/7047 | 439/359 |
| 6,155,857 | A * | 12/2000 | Kato | H01R 13/74 | 439/247 |
| 6,347,955 | B1 * | 2/2002 | Huang | H01R 13/629 | 439/357 |
| 6,877,992 | B2 * | 4/2005 | Grant | H01R 13/2435 | 439/591 |
| 6,939,158 | B2 * | 9/2005 | Moffett | H01R 13/6278 | 439/346 |
| 7,326,092 | B2 * | 2/2008 | Fedder | H01R 12/7005 | 361/756 |
| 7,726,982 | B2 * | 6/2010 | Ngo | H01R 13/42 | 439/206 |
| 7,766,664 | B2 * | 8/2010 | Cheng | H01R 12/7088 | 439/65 |

* cited by examiner

*Primary Examiner* — Phuong Dinh
(74) *Attorney, Agent, or Firm* — Roger D. Emerson; Emerson Thomson & Bennett

(57) ABSTRACT

An electrical connector with two guiding posts is disclosed. The electrical connector includes an insulation housing, multiple signal terminals and multiple power terminals. The insulation housing includes a flat base, a mating portion and two guiding posts. The mating portion forms multiple signal terminal insertion openings and multiple power terminal insertion openings. Each signal terminal has a head portion and a tail portion. The head portion is adjacent to the corresponding signal terminal insertion opening, and the tail portion extends out of the bottom surface of the insulation housing. Each power terminal has a head and a tail. The head is adjacent to the corresponding power terminal insertion opening, and the tail extends out of the bottom surface of the insulation housing. Each of the two guiding posts is symmetrically split into two separate sub guiding posts and forms a gap between the two sub guiding posts.

5 Claims, 6 Drawing Sheets

ELECTRICAL CONNECTOR WITH TWO GUIDING POSTS

BACKGROUND OF THE INVENTION

1. Field of the Invention

The present invention relates to a connector technology, and more particularly to an electrical connector with two guiding posts.

2. Description of the Prior Art

A common connection way of an electrical connector is a pluggable connection. In order to ensure that the electrical connector can be inserted correctly and be fixed on a correct position, a simple guiding structure is generally disposed on the electrical connector. But even if the electrical connector is provided with the guiding structure, it is still inevitable to generate an impact when the electrical connector is inserted into a complementary connector. After multiple insertion, these impacts will cause the electrical connector fatal damage, which affects its service life.

Hence, it is needed to provide a new electrical connector with two guiding posts, which can reduce or even completely absorb the impact force caused by two engaged electrical connector, to comply with the requirements of high precision.

BRIEF SUMMARY OF THE INVENTION

An object of the present invention is to provide an electrical connector with two guiding posts, wherein the two guiding posts are separately located on two sides of the electrical connector, and each of the two guiding posts forms two elastic and symmetrical split structures having a function of absorbing an impact force. When the electrical connector is engaged with a complementary connector, the two guiding posts not only can provide a guiding function, but also can absorb the impact force, thereby making the insertion and mating process be smoother.

The other object and the advantage of the present invention may be further understood from the technical features disclosed by the present invention.

To achieve the above object of the present invention, the present invention adopts the following technical solution.

The present invention provides an electrical connector with two guiding posts. The electrical connector comprises an insulation housing, multiple signal terminals and multiple power terminals. The insulation housing is upright and includes a flat base, a mating portion vertically extending upward from a top surface of the base, and two guiding posts being respectively located on a right and left sides of the mating portion and extending upward from the top surface of the base. The mating portion forms multiple signal terminal insertion openings and multiple power terminal insertion openings on a top surface of the mating portion. These insertion openings extend downward unto a bottom surface of the insulation housing for respectively forming multiple signal terminal passages and multiple power terminal passages. Each of the signal terminals is upright and has a head portion and a tail portion. The head portion is positioned in the corresponding signal terminal passage and is adjacent to the corresponding signal terminal insertion opening, and the tail portion extends out of the bottom surface of the insulation housing along the corresponding signal terminal passage. Each of the power terminals is upright and has a head and a tail. The head is positioned in the corresponding power terminal passage and is adjacent to the corresponding power terminal insertion opening, and the tail extends out of the bottom surface of the insulation housing along the corresponding power terminal passage. Wherein each of the two guiding posts is symmetrically split into two separate sub guiding posts and forms a gap between the two sub guiding posts.

In one embodiment, each guiding post has a vertical section vertically extending upward from the top surface of the base and being beyond the top surface of the mating portion, and an inclined section extending upward from the top of the vertical section.

In one embodiment, the vertical section and the inclined section commonly construct a first plane facing the mating portion.

In one embodiment, the vertical section and the inclined section commonly share a vertical plane facing the mating portion.

In one embodiment, the vertical section further has a second plane back to the mating portion, and the first plane and the second plane are parallel to each other and are separately located on two sides of the vertical section.

In one embodiment, the inclined section further has a curved surface back to the mating portion, and the diameter of the curved surface is reduced from bottom to top in a linear way to form a reduced top end.

In one embodiment, the curved surface is a conical surface.

In one embodiment, the mating portion further forms a guide pin insertion opening, which is located between two or two groups of adjacent power terminal insertion openings and extends downward to form a guide pin insertion hole.

In comparison with the prior art, the electrical connector of the present invention employs the two guiding posts, which are separately located on two sides of the electrical connector, and each of which forms two elastic and symmetrical split structures having a function of absorbing an impact force. The two guiding posts not only can provide a guiding function, but also can absorb the impact force generated during the mating process, thereby making the insertion and mating process be smoother.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
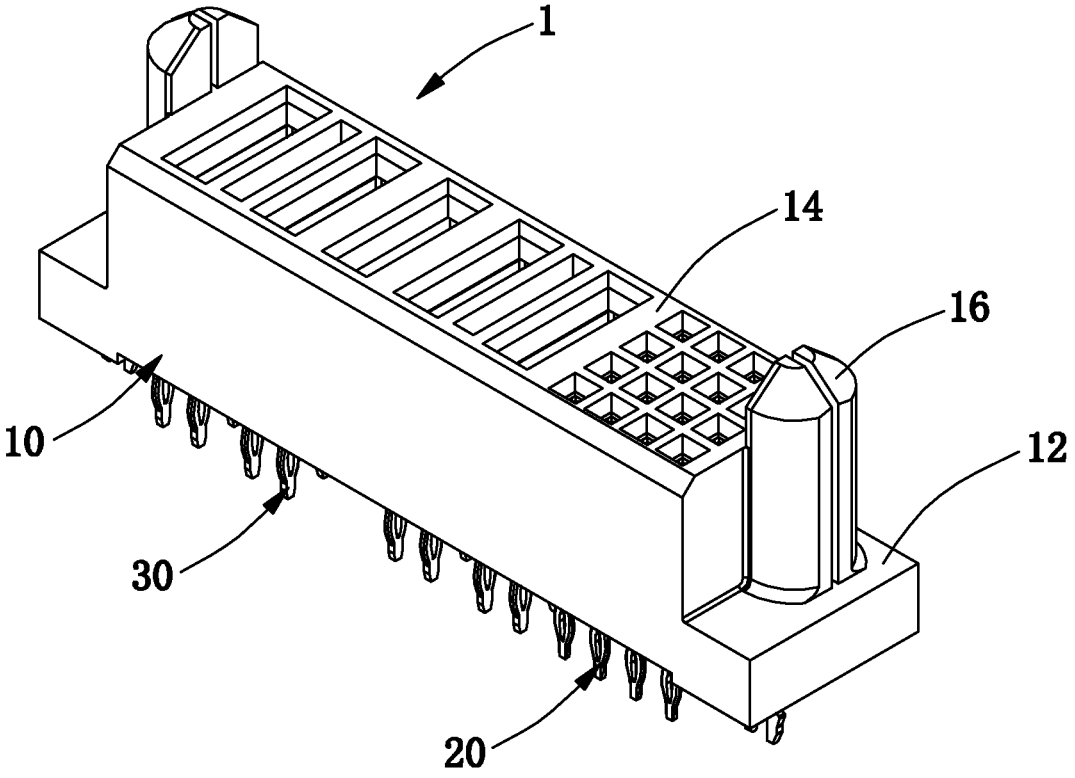
FIG. 1 is a perspective schematic view of an electrical connector of the present invention.
Figure 2:
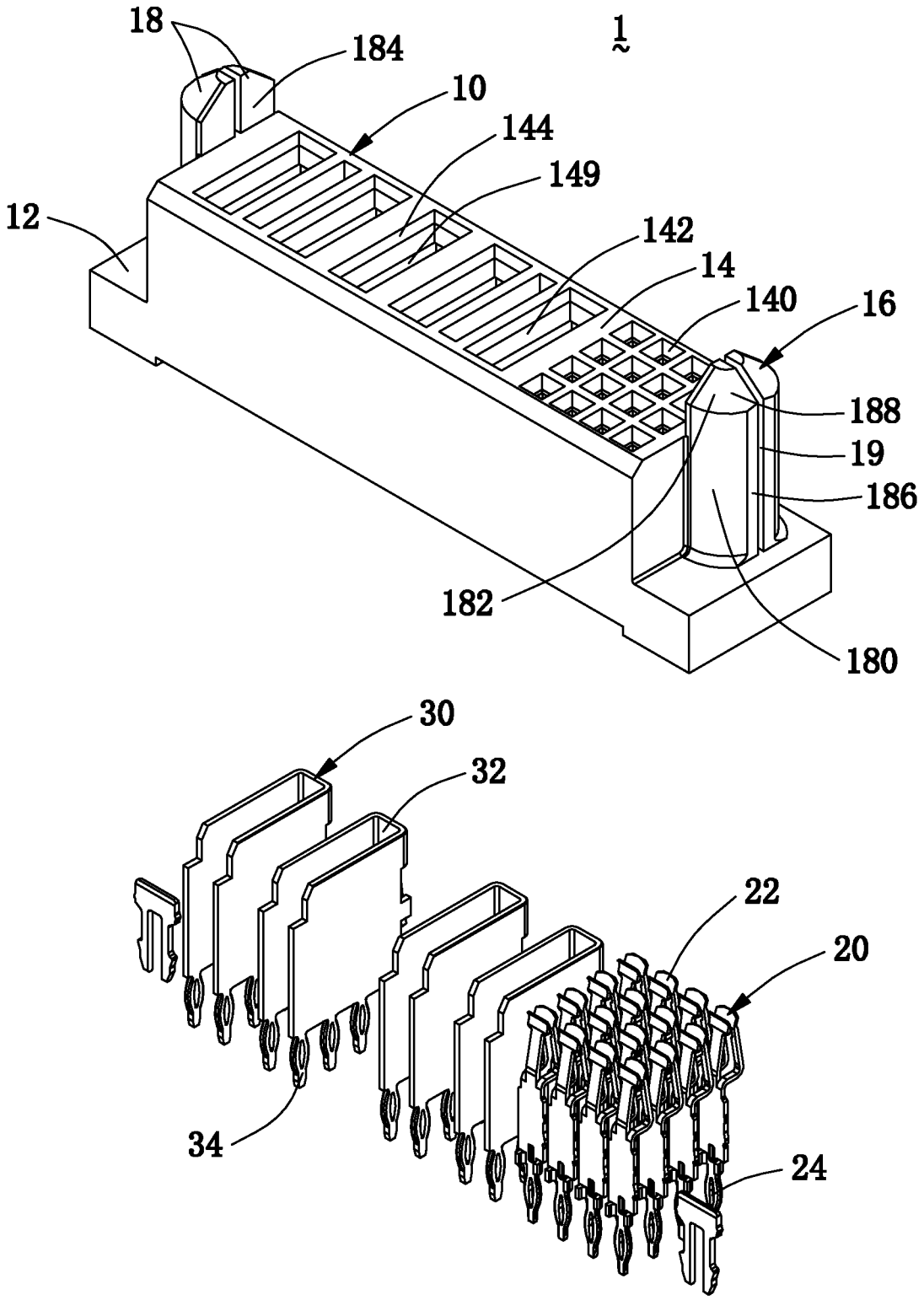
FIG. 2 is an exploded view of the electrical connector shown by FIG. 1.
Figure 3:
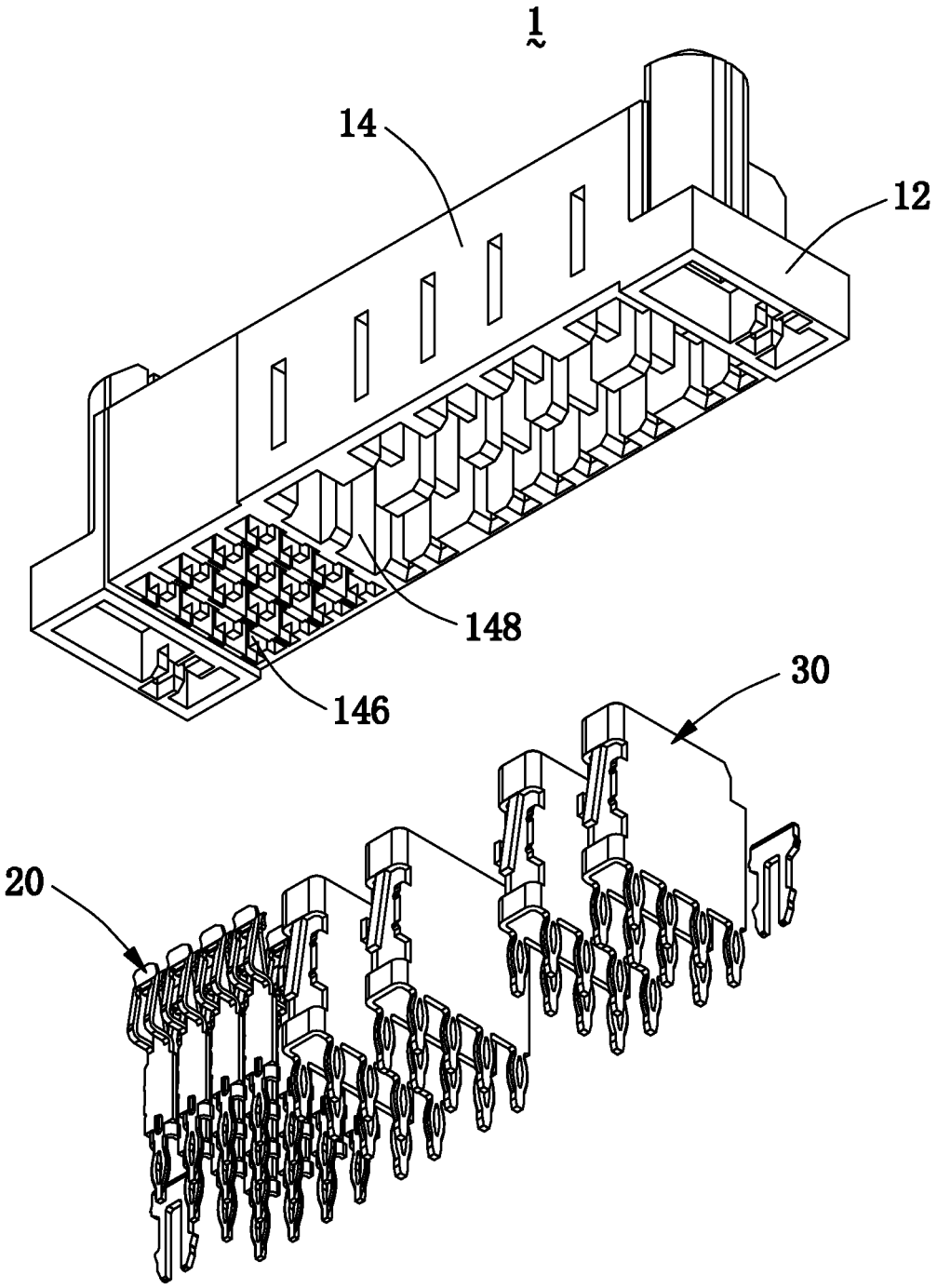
FIG. 3 is an exploded view of the electrical connector shown by FIG. 1 along another direction.
Figure 4:
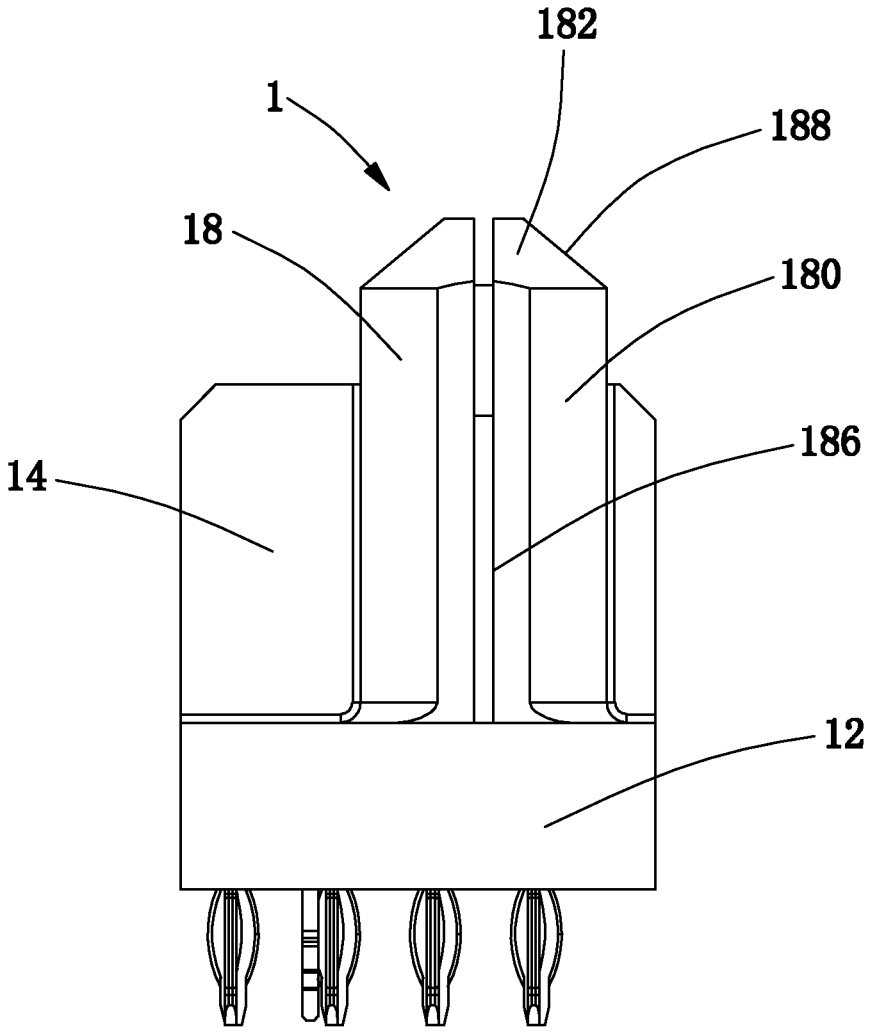
FIG. 4 is a right side view of the electrical connector shown by FIG. 1.
Figure 5:
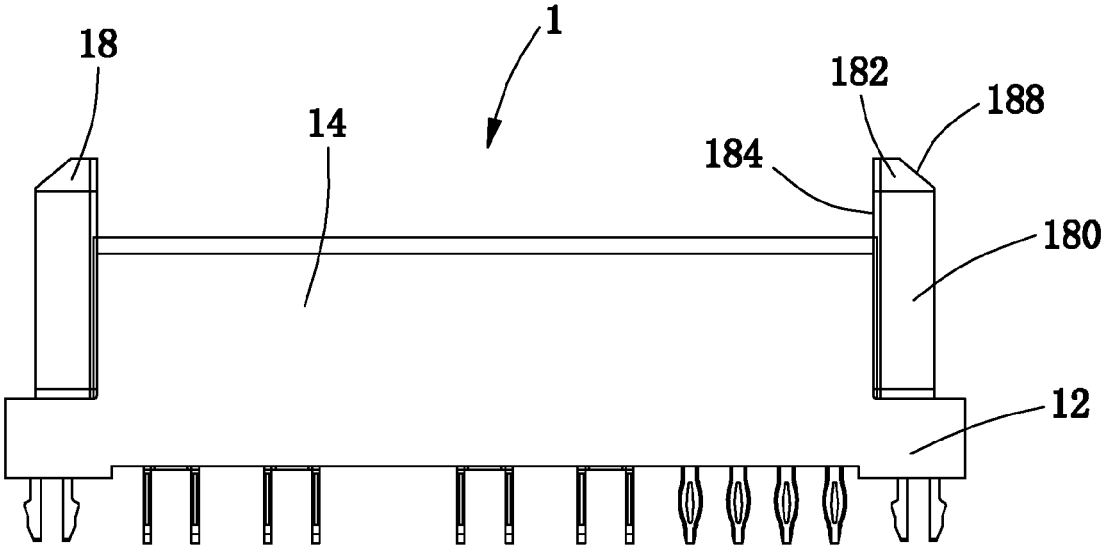
FIG. 5 is a front plane view of the electrical connector shown by FIG. 1.
Figure 6:
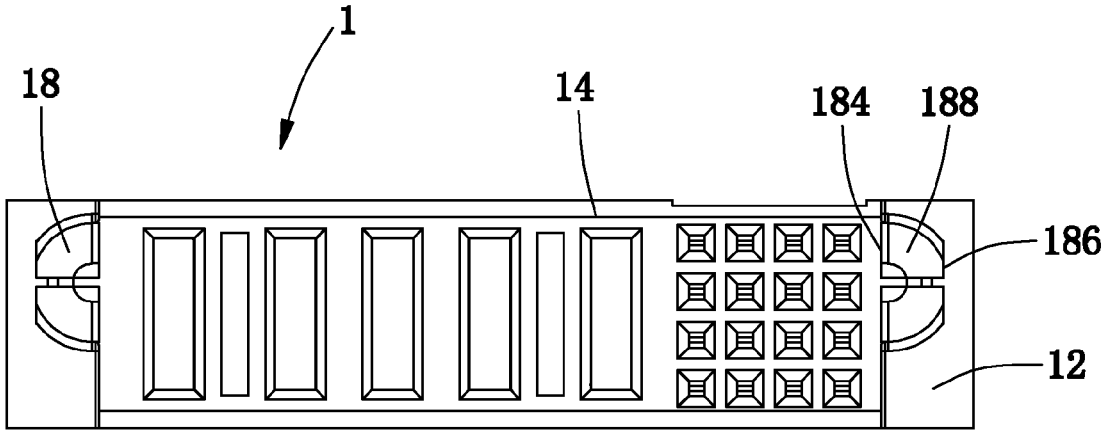
FIG. 6 is a top plane view of the electrical connector shown by FIG. 1.

Please refer to FIGS. 1 to 6, FIG. 1 is a perspective schematic view of an electrical connector 1 with two guiding posts of the present invention; FIG. 2 is an exploded view of the electrical connector 1 shown by FIG. 1; FIG. 3 is an exploded view of the electrical connector 1 along another direction; FIG. 4 is a right side view of the electrical connector 1; FIG. 5 is a front plane view of the electrical connector 1; and FIG. 6 is a top plane view of the electrical connector 1.

As shown in FIG. 1, the electrical connector 1 with two guiding posts is a vertical receptacle, the mating direction of which is perpendicular to a circuit board (not shown) and which can transport signal and power. The electrical connector 1 comprises an insulation housing 10, multiple signal terminals 20 and multiple power terminals 30.

As shown in FIG. 1, the insulation housing 10 is upright and has a flat base 12, a mating portion 14 extending upward on a top surface of the base 12, and two guiding posts 16 being respectively located on a right and left sides of the mating portion 14 and extending upward on the top surface of the base 12.

Please refer to FIGS. 2 and 3, the mating portion 14 forms multiple signal terminal insertion openings 140, multiple power terminal insertion openings 142 and a guide pin insertion opening 144 on a top surface thereof. The guide pin insertion opening 144 is located between two or two groups of adjacent power terminal insertion openings 142. These insertion openings 140, 142 and 144 extend downward unto a bottom surface of the base 12 to form multiple signal terminal passages 146, multiple power terminal passages 148 and a guide pin insertion hole 149 for respectively receiving and fixing the signal terminals 20, the power terminals 30 and a guide pin (not shown) of a complementary connector. Namely, the signal terminal insertion openings 140 extend downward to form the signal terminal passages 146, the power terminal insertion openings 142 extend downward to form the power terminal passages 148, and the guide pin insertion opening 144 extends downward to form the guide pin insertion hole 149. The guide pin insertion hole 149 is located between two or two groups of adjacent power terminal passages 148.

Please refer to FIG. 2, the two guiding posts 16 vertically extend upward from the top surface of the base 12 and are symmetrically disposed on two sides of the mating portion 14. Each guiding post 16 forms an elastic and symmetrical split structure. Specifically, the guiding post 16 is symmetrically split into two separate sub guiding posts 18 and forms a gap 19 between the two sub guiding posts 18. The gap 19 makes the guiding post 16 have an ability of elastic deformation along a direction of being perpendicular to the gap 19, thereby absorbing an impact force.

Please refer to FIGS. 2 to 6, each sub guiding post 18 has a vertical section 180 and an inclined section 182. The vertical section 180 vertically extends upward from the base 12 and is beyond the top surface of the mating portion 14 of the insulation housing 10. The inclined section 182 extends upward from the top of the vertical section 180. The vertical section 180 and the inclined section 182 commonly construct a first plane 184 facing the mating portion 14. Namely, the vertical section 180 and the inclined section 182 commonly share a vertical surface (that is, the first plane 184) facing the mating portion 14. Moreover, the vertical section 180 further has a second plane 186 back to the mating portion 14. The first plane 184 and the second plane 186 are parallel to each other and are separately located on two sides of the vertical section 180. The inclined section 182 further has a curved surface 188 back to the mating portion 14. In this embodiment, the curved surface 188 is a conical surface, the diameter of which is reduced from bottom to top in a linear way, so that the inclined section 182 forms a reduced top end. As shown in FIGS. 4 and 5, the curved surface 188 of the inclined section 182 is in favor of mating and guiding.

Please refer to FIG. 2, each signal terminal 20 is upright and has a head portion 22 and a tail portion 24. The head portion 22 is mounted in the corresponding signal terminal passage 146 and is adjacent to the corresponding signal terminal insertion opening 140 for being ready to be mated with a signal contact of the complementary connector. The tail portion 24 extends out of the bottom surface of the insulation housing 10 along the corresponding signal terminal passage 146.

Please refer to FIG. 2, each power terminal 30 is also upright and has a head 32 and a tail 34. The head 32 is mounted in the corresponding power terminal passage 148 and is adjacent to the corresponding power terminal insertion opening 142 for being ready to be mated with a power contact of the complementary connector. The tail 34 extends out of the bottom surface of the insulation housing 10 along the corresponding power terminal passage 148.

As described above, the electrical connector of the present invention disposes the two guiding posts 16 separately located on two sides thereof. Each of the two guiding posts 16 is symmetrically split into two separate sub guiding posts 18 and forms a gap 19 between the two sub guiding posts 18. This structure has a function of absorbing the impact force along a direction of being perpendicular to the gap 19. When the electrical connector 1 is engaged with the complementary connector, the two guiding posts 16 of the electrical connector 1 not only can provide a guiding function, but also can absorb the impact force generated during the mating process, thereby making the mating process be smoother.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector with two guiding posts, comprising:

an insulation housing being upright and including a flat base, a mating portion vertically extending upward from a top surface of the base, and two guiding posts being respectively located on a right and left sides of the mating portion and extending upward from the top surface of the base; the mating portion forming multiple signal terminal insertion openings and multiple power terminal insertion openings on a top surface of the mating portion; these insertion openings extending downward unto a bottom surface of the insulation housing for respectively forming multiple signal terminal passages and multiple power terminal passages;

multiple signal terminals, each of which is upright and has a head portion and a tail portion; the head portion being positioned in the corresponding signal terminal passage and adjacent to the corresponding signal terminal insertion opening, and the tail portion extending out of the bottom surface of the insulation housing along the corresponding signal terminal passage; and multiple power terminals, each of which is upright and has a head and a tail; the head being positioned in the corresponding power terminal passage and adjacent to the corresponding power terminal insertion opening, and the tail extending out of the bottom surface of the insulation housing along the corresponding power terminal passage;

wherein each of the two guiding posts is symmetrically split into two separate sub guiding posts and forms a gap between the two sub guiding posts;

wherein each guiding post has a vertical section vertically extending upward from the top surface of the base and being beyond the top surface of the mating portion, and an inclined section extending upward from the top of the vertical section; the vertical section and the inclined section commonly construct a first plane facing the mating portion.

2. The electrical connector with two guiding posts as claimed in claim 1, wherein the vertical section further has a second plane facing away from to the mating portion, and the first plane and the second plane are parallel to each other and are separately located on two sides of the vertical section.

3. The electrical connector with two guiding posts as claimed in claim 2, wherein the inclined section further has a curved surface back to the mating portion, and the diameter of the curved surface is reduced from bottom to top in a linear way to form a reduced top end.

4. The electrical connector with two guiding posts as claimed in claim 3, wherein the curved surface is a conical surface.

5. The electrical connector with two guiding posts as claimed in claim 1, wherein the mating portion further forms a guide pin insertion opening, which is located between two or two groups of adjacent power terminal insertion openings and extends downward to form a guide pin insertion hole.

* * * * *